United States Patent [19]

Schulz et al.

[11] 3,980,848

[45] Sept. 14, 1976

[54] DEVICE FOR THE REMOTE CONTROL OF MOTIONS AND OPERATIONS OF MICROSURGICAL EQUIPMENT

[75] Inventors: Kurt Schulz; Gunther Sümmerer, both of Oberkochen, Germany

[73] Assignee: Carl Zeiss-Stiftung, Oberkochen, Germany

[22] Filed: Nov. 21, 1974

[21] Appl. No.: 525,972

Related U.S. Application Data

[62] Division of Ser. No. 405,482, Oct. 11, 1973, abandoned.

[30] Foreign Application Priority Data

Oct. 16, 1972 Germany ..... 379125

[52] U.S. Cl. ..... 200/86.5; 200/153 C

[51] Int. Cl.[2] ..... H01H 3/14

[58] Field of Search ..... 200/6 A, 61.47, 52 R, 200/86.5, 153 C, 153 W, 159 R, 153 L, 153 LA, 61.58 R; 297/71

[56] References Cited

UNITED STATES PATENTS

| | | | |
|---|---|---|---|
| 1,158,083 | 10/1915 | Stout | 200/6 A UX |
| 2,507,016 | 5/1950 | Hesh | 200/6 A |
| 2,560,873 | 7/1951 | Keckley | 200/153 C X |
| 2,686,234 | 8/1954 | Obszarny | 200/6 A |
| 3,027,807 | 4/1962 | Barcus et al. | 200/6 A X |
| 3,482,072 | 12/1969 | Taylor et al. | 200/159 R |
| 3,637,964 | 1/1972 | Iuko | 200/86.5 |
| 3,708,636 | 1/1973 | Sobchak | 200/6 A |
| 3,917,918 | 11/1975 | Vannest et al. | 200/6 A |

*Primary Examiner*—James R. Scott
*Attorney, Agent, or Firm*—Nichol M. Sandoe

[57] ABSTRACT

A device for the remote control of motions and operations, especially on microsurgical equipment, comprises a multiple switch assembly in which the operation of the selected switches is controlled by movement of a control member. Operation of the switches closes or opens electrical circuits which include servomechanisms for moving the equipment. The switches are mounted in a housing and the control member comprises a plate having a stud extending through an aperture in the cover of the housing. Selective operation of the switches is brought about by transverse movement of the plate and stud in various directions.

3 Claims, 7 Drawing Figures

Figure 5:
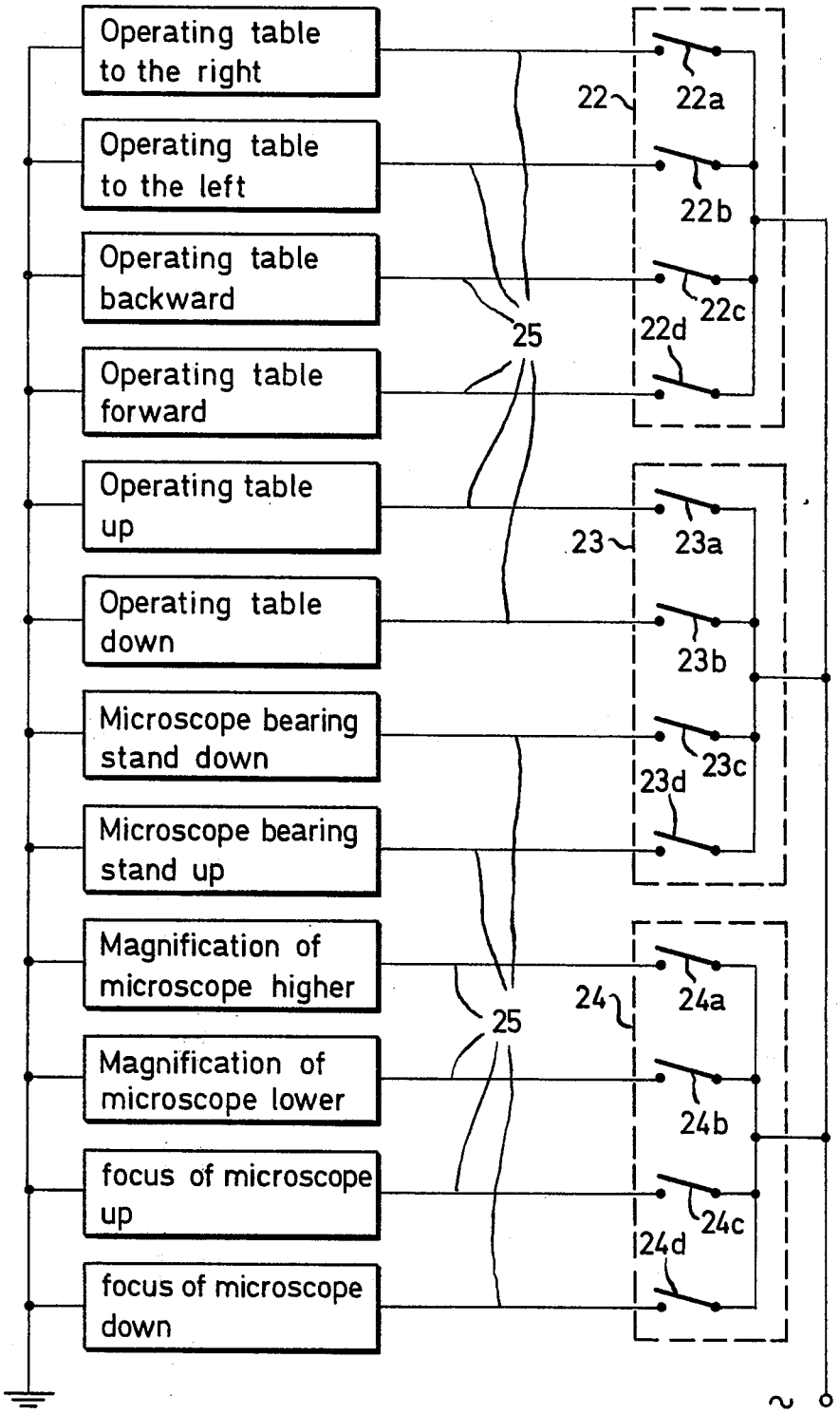

Fig.1
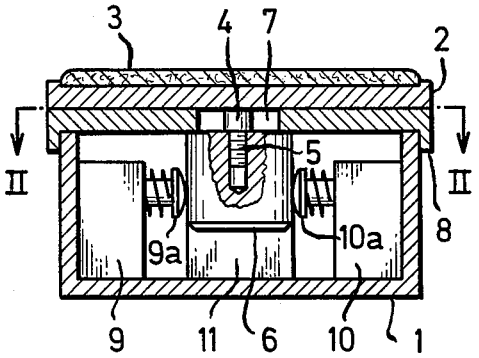
Fig.2
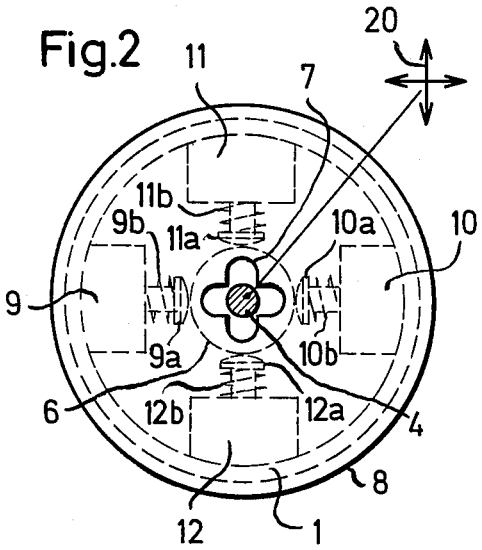
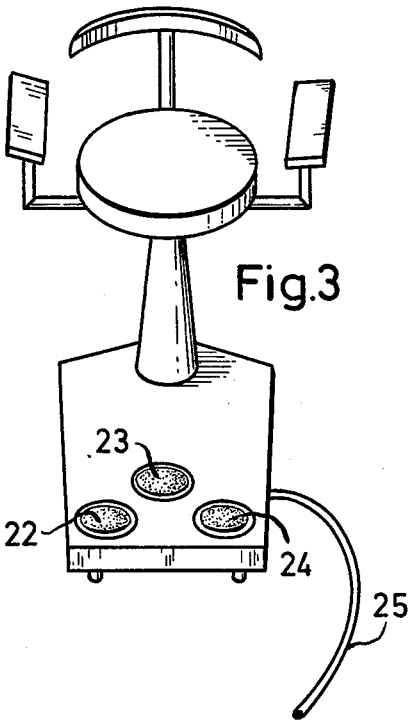
Fig.3
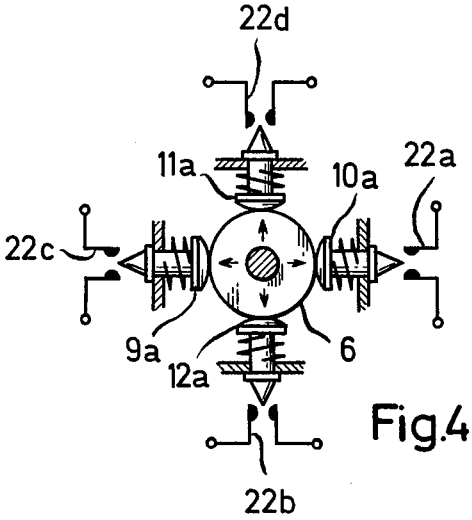
Fig.4

DEVICE FOR THE REMOTE CONTROL OF MOTIONS AND OPERATIONS OF MICROSURGICAL EQUIPMENT

This is a division of application Ser. No. 405,482, filed Oct. 11, 1973 now abandoned.

This invention relates to apparatus for the remote control of motions and operations, especially on microsurgical equipment, in which servo mechanisms which perform motions are connected with the microsurgical equipment and are controlled by electrical switches which make and break circuits which include servo mechanisms.

During microsurgical operations, it is necessary for the surgeon to perform a large number of mechanical manipulations of his equipment and aids while carrying on his surgical activity. These manipulations include, for example, refocusing of the operation microscope on the object, change of magnification to extend or reduce the field of view, and horizontal or vertical displacements of the operating table with corresponding adjustments of the optical instruments. In order to relieve the surgeon of some of the effort involved in the performance of these manipulations, a device is required to enable the surgeon to perform them with the least possible effort and which leaves the surgeon's hands free for the performance of their primary function.

Pedal operated controls for microsurgical equipment are in existence in which foot-sized levers are used with long contact travel. As one such lever can only fulfill two functions, the control panel becomes very large if several functions are required. If levers for separate functions are widely separated, the surgeon must either grope for them with his foot or take his eyes and attention away from the operating field. Furthermore, the long contact travel of the existing lever mechanisms are known to cause straining and cramping of the foot muscles.

The object of this invention, therefore, is to avoid the disadvantages of such existing control mechanisms for microsurgical equipment and to simplify such mechanisms and facilitate their use. This object is achieved in accordance with the invention by the use of one or more electrical multiple switch assemblies, each of which is operated by movement of a control member preferably in the form of a plate having a stud secured thereto, said plate and stud being movable in various directions transverse to the axis of the stud. Means are provided whereby movements of said plate and stud in selected directions actuate selectively one of the switches of the assembly to close a circuit which includes servo mechanisms to initiate the desired motion or function.

In a preferred form of the invention, one or more four-way switch assemblies are mounted in a control panel arranged for operation by the surgeon's foot. For example, several four-way switch assemblies may be mounted in the base of the operating chair. Thus, with only three switch assemblies, twelve different functions can be controlled.

The essential advantage of the invention is that more functions can be initiated with fewer control members. This reduces the danger of getting control members mixed up and obviates bothersome searching for the desired member. The short travel distance of the four-way switch assemblies and their ease of operation avoid excessive strain on the muscles. Moreover, the operation of the switches is logical: if the operating table is to be moved right or left, the corresponding control member is moved to the right or left, respectively. If an instrument is to be moved forward or backward, the control member is moved forward or backward, respectively.

Figure 6:
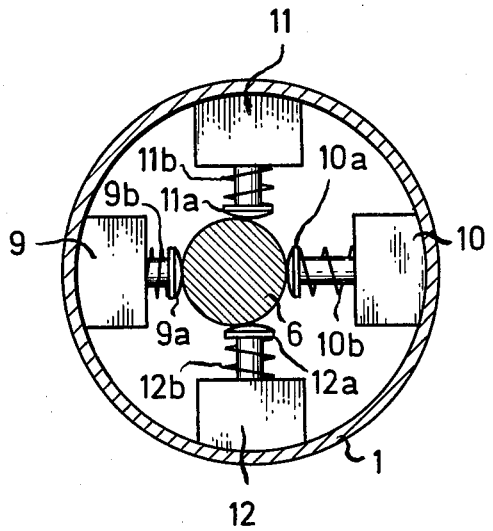
Figure 7:
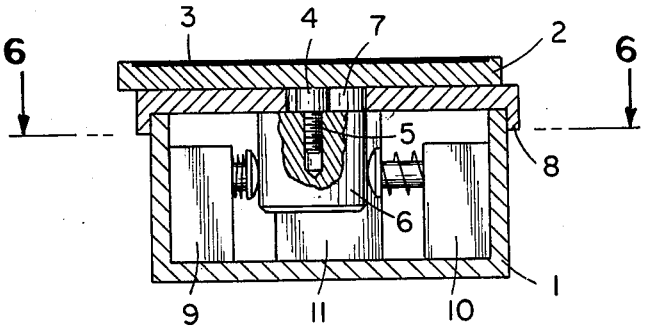

A preferred embodiment of the invention is shown in the accompanying drawings, in which, FIG. 1 is a side elevation of a four-way switch assembly, partly broken away to show the interior, FIG. 2 is a section on the line II—II of FIG. 1, FIG. 3 is a perspective view of an operating chair with three four-way switch assemblies mounted in the base for control of microsurgical equipment, FIG. 4 is a skeletonized plan view showing the inside of the switch pin-holding blocks, FIG. 5 is a circuit diagram of a switch system utilizing three four-way switch assemblies shown in FIG. 3 to control twelve functions, FIG. 6 is a view similar to FIG. 2 but showing the device actuated to close the switch 9; and FIG. 7 is a sectional view similar to FIG. 1 but showing the parts in the relative positions of FIG. 6.

Referring to FIGS. 1 and 2, the invention is shown as applied to a four-way switch assembly which comprises a cylindrical housing 1, a control member in the form of a plate 2, preferably covered by a layer of plastic 3 having a corrugated, non-skid surface, and a cover plate 8 located between the plate 2 and the housing 1 and which closes the housing. The cover plate 8 is provided with a central aperture 7 having four symmetrically arranged radial flutes. A stud 4 of smaller diameter than that of the aperture is secured to cover plate 2 and projects downwardly through aperture 7. The stud is dimensioned to fit the flutes and when plate 2 is moved in any one of the arrowed directions 20, the stud moves into one of the flutes of the aperture 7. Four switch blocks 9–12 are mounted within the housing at equally spaced intervals, each of said switch blocks containing a switch which is aligned with one of said flutes. Means carried by said stud are provided for selectively actuating said switches on movement of said control member and stud in directions transverse to the axis of said stud. Thus, stud 4 is screwed into a cylindrical block 6 which moves in accordance with each movement of the stud. According to the direction in which the block is moved, the block moves one of the switch pins 9*a*–12*a* held in switch blocks 9–12 by springs 9*b*–12*b*. As shown in FIG. 4, upon such movement, one of the switch pins 9*a*–12*a* bridges one of the contacts 22*a*–22*d* to close a circuit which initiates the desired motion of the equipment via servomotors.

The control panel 26 of the operating chair shown in perspective in FIG. 3 is connected by the cable 25 with the microsurgical equipment and aids and has three four-way switch assemblies 22, 23 and 24 mounted therein.

FIG. 5 illustrates a circuit diagram which shows the manner in which movement of the control plates 2 of the three four-way switch assemblies may be used to control twelve functions. The switch assembly 22, for example, may be used to control movement of the operating table in four different directions, right, left, forward and backward. Thus, if the plate 2 of the switch assembly 22 is moved to the right as shown in FIG. 4 to cause switch pin 10*a* to bridge contacts 22*a*, a circuit will be closed to energize a servo motor to move the operating table to the right.

Similarly, by proper movements of the plate 2 of switch assemblies 23 and 24, the switch pins may be actuated to close the circuits to perform the indicated functions.

What is claimed is:

1. In an operating chair for surgical operations under a microscope, having a control panel on which the chair is mounted, a plurality of switch assemblies mounted in the upper surface of said panel and arranged for operation by a surgeon's foot for the remote control of motions and operations of surgical and microscopical equipment, each of said switch assemblies comprising a housing, a cover plate for said housing, said cover plate having an aperture extending therethrough, a control member mounted above said cover plate and being laterally slidable thereon, said control member having a stud secured thereto which extends downwardly through said aperture, the diameter of said stud being less than the diameter of said aperture, a plurality of switches mounted within said housing and arranged around said stud, and means carried by said stud for actuating any selected one of said switches on lateral movement of said control member and stud in a direction transverse to the axis of said stud and toward said selected switch.

2. Apparatus as claimed in claim 1 in which said aperture is provided with a plurality of symmetrically arranged radial flutes, and in which said stud is dimensioned to enter said flutes.

3. Apparatus as claimed in claim 2 in which the number of switches in said housing corresponds to the number of said flutes, and in which said switches are aligned with said flutes.

* * * * *